US008328225B2

(12) United States Patent
Prigge et al.

(10) Patent No.: US 8,328,225 B2
(45) Date of Patent: Dec. 11, 2012

(54) SKI BINDING ADAPTOR WITH FLOATING HEEL LOCK

(76) Inventors: Jason M Prigge, Cottonwood Heights, UT (US); William J Ritter, Bozeman, MT (US); John Parker, Bozeman, MT (US); Dylan Bourke, Bozeman, MT (US)

( * ) Notice: Subject to any disclaimer, the term of this patent is extended or adjusted under 35 U.S.C. 154(b) by 383 days.

(21) Appl. No.: 12/843,020

(22) Filed: Jul. 24, 2010

(65) Prior Publication Data

US 2011/0018232 A1 Jan. 27, 2011

Related U.S. Application Data

(60) Provisional application No. 61/228,516, filed on Jul. 24, 2009.

(51) Int. Cl.
*A63C 9/00* (2006.01)

(52) U.S. Cl. ..... 280/614; 280/618

(58) Field of Classification Search ..... 280/607, 280/614, 615, 617, 618, 633, 634
See application file for complete search history.

(56) References Cited

U.S. PATENT DOCUMENTS

| | | | | | |
|---|---|---|---|---|---|
| 4,358,131 | A * | 11/1982 | Schwartz | 280/614 |
| 4,436,322 | A * | 3/1984 | Wittmann et al. | 280/614 |
| 4,513,988 | A * | 4/1985 | Svoboda | 280/615 |
| 4,635,955 | A * | 1/1987 | Zoor | 280/614 |
| 4,674,766 | A * | 6/1987 | Ramer | 280/614 |
| 5,129,668 | A * | 7/1992 | Hecht | 280/607 |
| 5,318,320 | A * | 6/1994 | Ramer | 280/614 |
| 5,421,602 | A * | 6/1995 | Stepanek et al. | 280/602 |
| 5,560,633 | A * | 10/1996 | McGowan | 280/614 |
| 5,671,939 | A * | 9/1997 | Pineau | 280/602 |
| 6,325,404 | B1 * | 12/2001 | Liard et al. | 280/607 |
| 6,431,578 | B2 * | 8/2002 | Pedersen et al. | 280/626 |
| 7,264,263 | B2 * | 9/2007 | Riedel et al. | 280/614 |
| 7,401,802 | B2 * | 7/2008 | Walker et al. | 280/614 |
| 7,735,851 | B2 * | 6/2010 | Shute et al. | 280/614 |
| 7,938,432 | B2 * | 5/2011 | Schlegel et al. | 280/601 |
| 8,181,985 | B2 * | 5/2012 | Mangold et al. | 280/614 |
| 8,191,918 | B2 * | 6/2012 | Pupko | 280/618 |
| 2003/0137129 | A1 * | 7/2003 | DuBuque | 280/615 |

* cited by examiner

*Primary Examiner* — Katy M Ebner
(74) *Attorney, Agent, or Firm* — K Karel Lambert; Lambert Patent Services LLC

(57) ABSTRACT

AT ski binding adaptor for alpine ski touring and downhill, including a floating heel lock assembly and multifunctional rotatable locking arms. Ski bindings are mounted on an adaptor mounting plate, channel or beam assembly that pivots at the toe. The heel lock mechanism "floats" on a rail or rails to accommodate ski flex, and includes a multi-position climbing bar or heel riser. The floating heelblock and locking mechanism are interconvertible for different ski modes: in fixed heel-mode—the locking arms act to firmly secure the heel to the ski for aggressive downhill conditions or riding style, and in free heel mode—the locking arms may be configured to support touring and climbing configurations. The ski binding adaptor with floating heel lock mechanism is optionally compatible with a range of alpine ski touring and downhill bindings.

17 Claims, 12 Drawing Sheets

35
30
31
25
21
20
32
11
15b
15a
12a
12
13
14
15

Fig. 12A
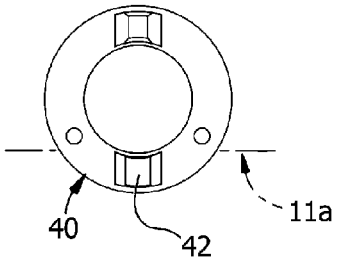
Fig. 12B
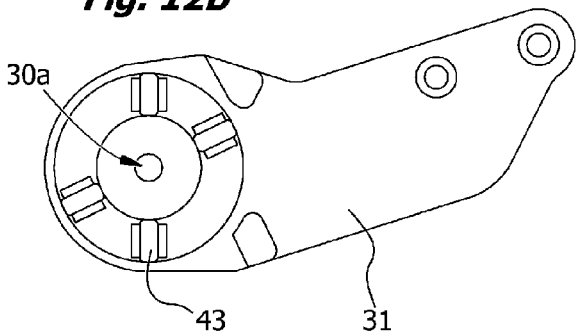
Fig. 13A
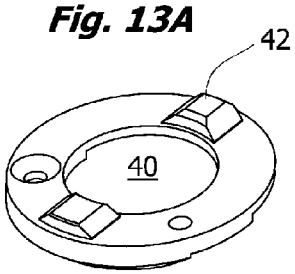
Fig. 13B
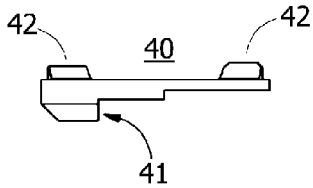
Fig. 14
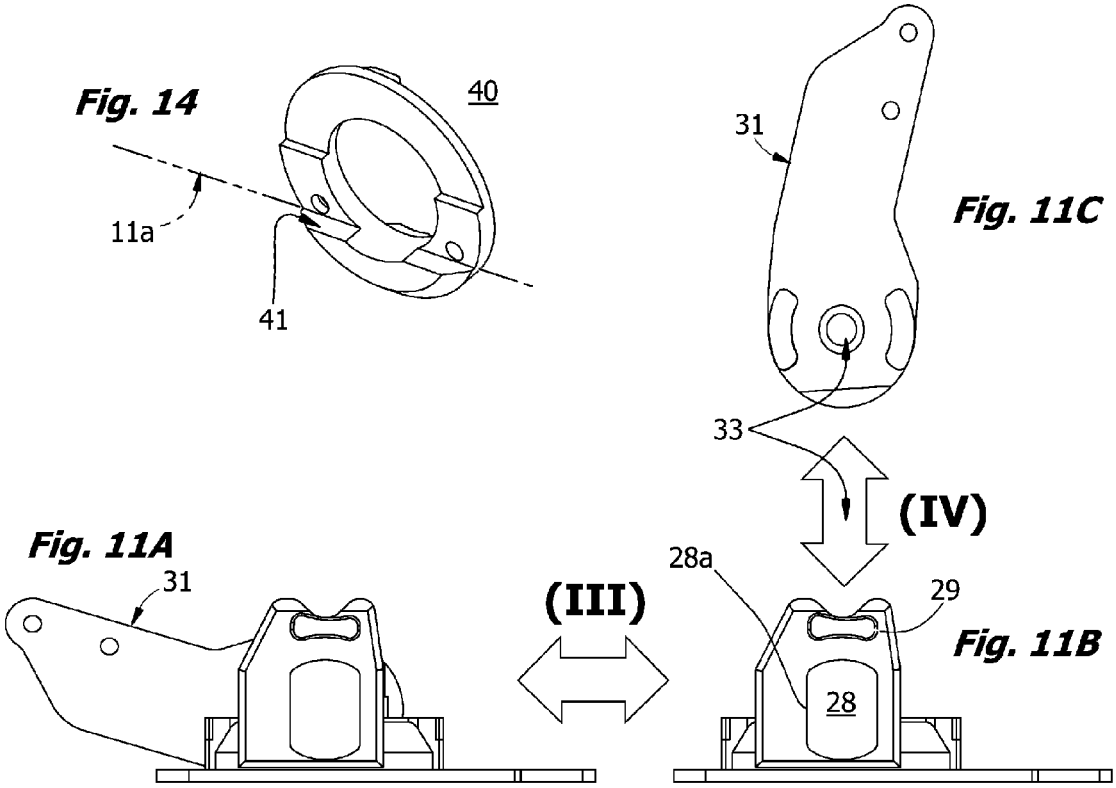
Fig. 11C
Fig. 11B
Fig. 11A Fig. 18C
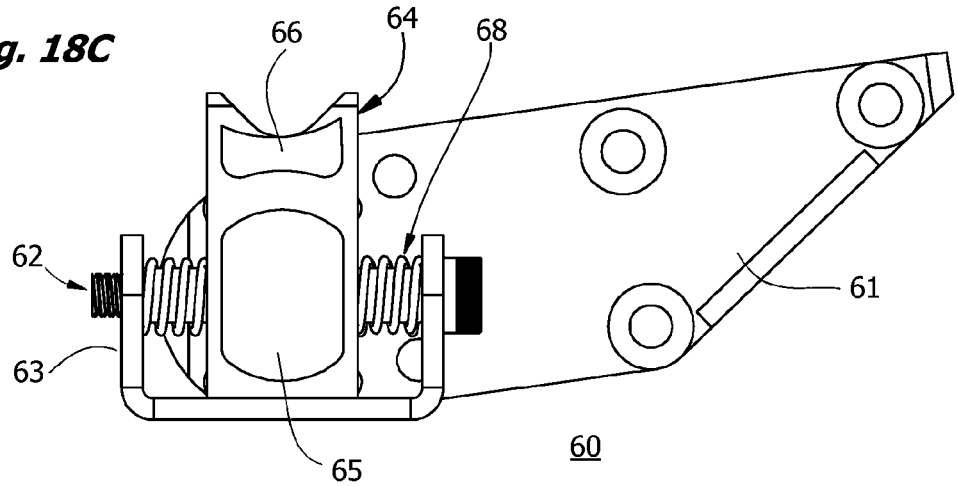
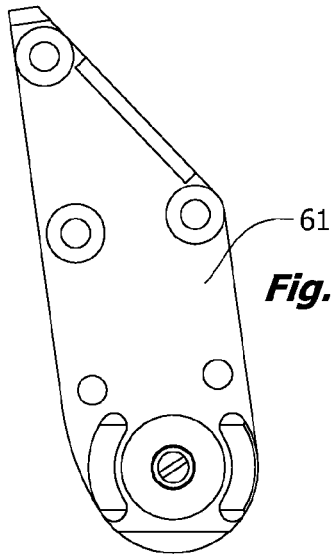
Fig. 19A
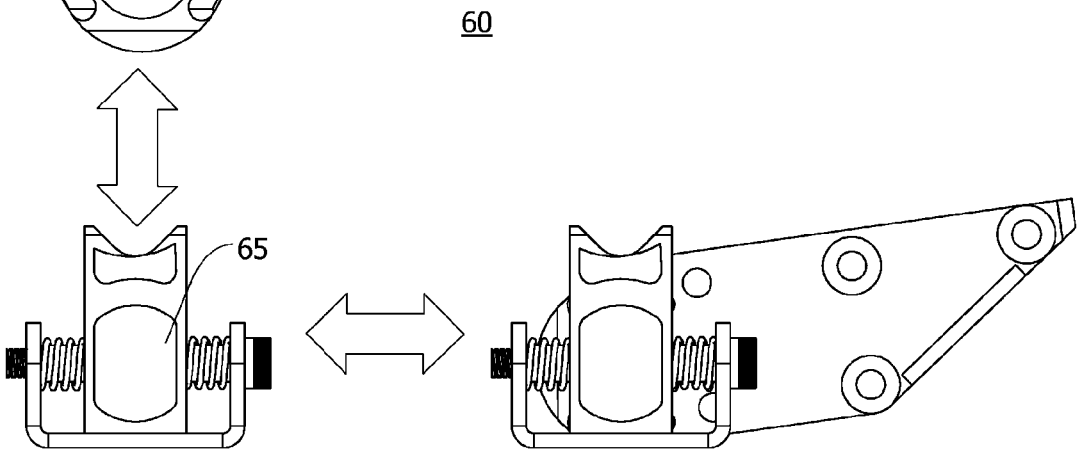
Fig. 19B
Fig. 19C

SKI BINDING ADAPTOR WITH FLOATING HEEL LOCK

CROSS-REFERENCE TO RELATED APPLICATIONS

This application claims the benefit of 35 U.S.C. §119(e) for priority to U.S. Provisional Patent Application No. 61/228,516 filed Jul. 24, 2009; said priority document being incorporated herein in entirety by reference.

FIELD OF THE INVENTION

The invention relates to alpine-touring ski binding adaptor designed to interchangeably secure a boot to a ski, and to a floating heel locking mechanism for accommodating ski flex during fixed heel skiing.

BACKGROUND

Alpine-touring (AT) ski bindings offer the versatility of skiing in "downhill" (fixed heel) or "touring" (free heel) modes. AT skiing has been enjoyed in Europe for decades, where it was known originally as randonnee skiing, but only more recently has it gained popularity in the United States.

Conventional AT bindings function in two ways. For touring in free heel mode, a rear locking clasp is opened, allowing the heel to lift free of the ski, so that the heel can pivot with respect to the ball of the foot or the toe. A free heel is preferable for a natural striding motion, for kick and gliding in the snowy backcountry, or for climbing slopes on skis. On a downhill, the heel clasp is optionally locked down to secure the heel, allowing the skier to aggressively apply more power through the binding for turning and carving with the ski edges (as with conventional alpine bindings), and provides more support for protection of the knees and ankles.

Although the earliest AT bindings, such as the Silvretta Saas Fee, had a pivotable toe and a heel support, a plate or frame supporting the bootsole soon gained preference. An early representation of an AT binding is described by Hollenback (U.S. Pat. No. 3,388,918). As shown in FIG. 1, the binding includes a frame member (1) pivotably attached to the ski blade (2) at the toe and a releasable butterfly nut (3) for restraining the frame member at the heel when desired. Also shown are heel and toe restraints for holding the boot.

McGowan in expired U.S. Pat. No. 5,560,633 provides for a scissors device with frame that hinges at the toe on a mounting bar, which in turn reversibly clips into conventional ski binding toe and heel members on the ski. The pivotable frame is extensible with adjustment for boot size and includes bails for securing a boot. Engageable climbing bars are affixed to the lower mounting bar of the scissors frame. The device has been well received because it can be clipped into any alpine ski binding without tools, affording crossover flexibility but at the expense of substantially increased weight. The torque of a fall will not reliably release the device from the ski, which can result in injury, and the boot is necessarily elevated to accommodate the raised mounting bar. It is thought that building an adaptor plate without these problems would add great weight and expense.

Ramer, in U.S. Pat. No. 4,674,766 shows a simple clasp for securing an extensible plate at the heel. In U.S. Pat. No. 5,328,320, also to Ramer, the clasp (5) is modified to reversibly engage a tab (6) projecting from the heel plate (4) and rotates up and away to release the heel plate, as shown here in FIG. 2. The rotatable clasp is secured in a locked position by a spring-loaded cam. The clasp is further modified to include a pair of risers (7,8) for supporting the heel at one of two angles above the ski. However, the clasp does not accommodate flexing of the ski under the binding, which can damage the ski blade (2) or the binding and leads to loss of camber with use, particularly with soft-flexing skis that have a wide tip and a very narrow waist.

Fritschi, in U.S. Pat. No. 5,735,541 describes a hollow tubular carrier beam hingedly secured at the toe to a ski, with a heel binding jaw member slideably mounted on the beam for securing the boot against the toe release anvil. A locking member engages the rear endcap of the beam and locks down the heel when flat, and serves as a riser when standing. Unfortunately however, bowing of the ski can release the locking member from the endcap, resulting in unwanted detachment of the heel on one or both skis. And because the skier's boot rides on toe and heel platforms above the carrier beam, the skier is elevated above the ski by an undesirable height for some riding styles.

More generally, rotational and torsional forces on the carrier beam tend to focus on the toe pivot cradle and axial pin, leading to undesirable lateral play and looseness over time with use, which can necessitate replacement of the entire binding assembly. It would be preferable for a binding to be supplied with a toe pivot cradle independent of the toe release so that it is easily replaced, and which spreads the loads on the toe cradle so as to reduce wear and fatigue.

In the interests preventing broken bones and torn knees, conventional toe and heel bindings are supplied with breakaway releases that detach when torsional forces on the boot exceed safe limits. Industry standards have been developed for performance and testing of release mechanisms. Because conventional AT bindings are built with a hinge at the toe, the toe release mechanism is not as strong as alpine ski bindings. Thus the durability of AT bindings known in the art is not trusted for aggressive skiing and under harder or variable snow conditions, and a skier wishing both types of skiing will likely have two pairs of skis, one of which is fitted with the AT ski bindings, the other with the alpine ski bindings—at additional expense and inconvenience.

As currently practiced, it is not possible to conveniently exchange or swap out bindings from ski to ski. In contrast, the AT ski binding adaptor of the present invention permits the skier to readily move bindings from ski to ski. The inventive AT ski binding adaptor is supplied with a reversible heel lock for crossover flexibility between fixed heel and free heel modes. The floating heel lock mechanism accommodates the flexing of the skis under a variety of ski conditions and terrain favored by modern skiers. In a preferred embodiment, the ski binding adaptor is compatible with multiple ski bindings, and is thus a "universal" adaptor mounting plate. Other advantages will be apparent from the following drawings and description.

BRIEF DESCRIPTION OF THE DRAWINGS

The teachings of the present invention can be readily understood by considering the following detailed description in conjunction with the accompanying drawings, in which:

FIGS. 11A, B and C depict the action of the stinger arms in unlocking from the floating heelblock.

FIGS. 12A and B show a reverse face of a detent disk with detent posts and a mating surface of a stinger arm with detent stops.

FIGS. 13A-B show a perspective view of a detent posts of the detent disk, an edge view of the detent disk, respectively.

FIG. 14 is a perspective view of the front face of a detent disk, illustrating how step ledges on the detent disk engage the bottom edge of the channel beam so that the detent disk does not rotate with respect to the channel beam.

FIGS. 19A, B and C depict the action of the stinger arm in lockingly engaging the floating heelblock in a second embodiment.

SUMMARY

Figure 1:
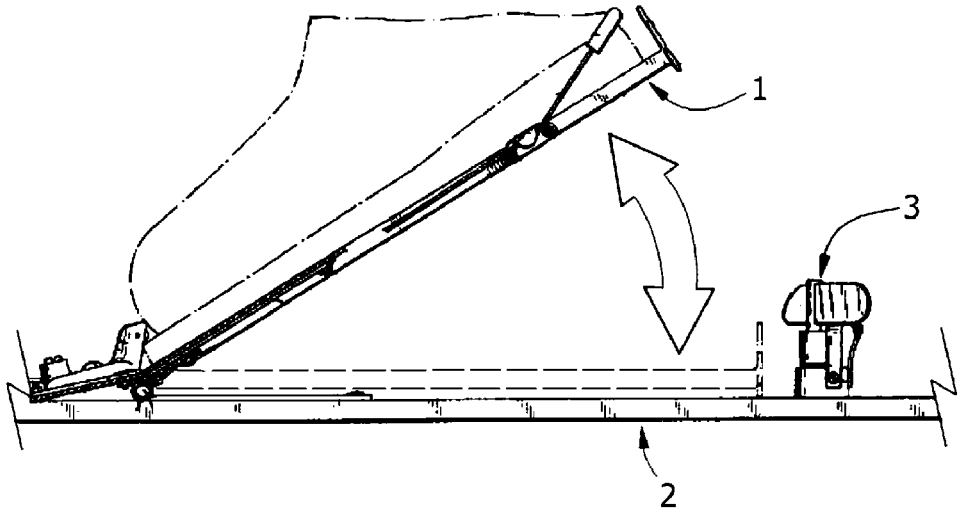
Fig. 1 PRIOR ART
FIGS. 1 and 2 are representative AT ski bindings of the prior art. The device of FIG. 1 is described in detail in U.S. Pat. No. 3,388,918. The device of FIG. 2 is described in U.S. Pat. No. 5,328,320.

Claimed here is a ski binding adaptor with floating heel lock mechanism for on-demand conversion between downhill (fixed heel) and touring (free heel) modes, the "floating" heel mechanism preventing disengagement of the heel lock during ski flex and decreasing concentration of bending forces around the toe pivot with ski flex.

According to a first aspect of the invention, realized here is a pivotable "ski binding adaptor" or mounting system with reversibly fixed heel, which adapts alpine ski bindings for use in alpine touring. The mounting system includes a plate, beam, frame or "channel" that pivots at the toe in a toe pivot cradle and sits low on the ski, affording performance, stability and control, also serving as a point of attachment for the ski binding components and boots. As a matter of terminology, the pivotable plate, beam, frame or channel is termed more generally a "pivotable elongate support member" or "elongate ski binding support member" having the function of providing a pivotable surface for mounting and supporting the toe and heel pieces of the ski bindings, and thus extends from a toe end with pivot to a heel end and is sized accordingly, and has also been termed an "adaptor mounting plate". The support member may be configured for attaching to a particular make of ski binding, or may be a "universal" mount for more than one make of ski binding.

To use the invention, the skier mounts a pair of alpine ski bindings on the elongate support member. The elongate support member thus serves as a pivotable extension of the ski. This branched, pivotable extension is generally rigid and sturdy so as to better transmit force applied by the skier during turns and carving and to resist wear during free heel ski touring. Unlike most AT bindings, the support member is supplied with a toe pivot cradle and pins that are readily replaced if damaged during free heel skiing.

Conventional alpine ski bindings include release mechanisms on either the toe or heel, or on both toe and heel, and are set by the user to release at a pre-selected torsional dislocation. The release mechanism reduces risk of injury and is adjusted according to the skill and physique of the user to prevent pre-release. Therefore, there is no need for a redundant release mechanism in the toe and heel of the elongate support member. Any alpine ski binding with any range of DIN settings offered by a manufacturer may thus be incorporated in the AT binding assemblies of the present invention.

According to a second aspect of the invention, the heel lock mechanism permits flex of the ski without stress on the ski binding (that can lead to detachment of the heel with other systems) or fracture of the ski blades around the toe pivot while in fixed heel mode, such as for downhill skiing. Strain is relieved by use of a "floating heelblock" which slidably rides on a rail, a system of rails, or for example on smooth shanked shoulder bolts, and remains attached under all skiing conditions. The pivotable channel engages the floating heelblock through a pair of lever arms (or as termed here more commonly "stinger arms") mounted on the heel end of the elongate support member, and which reversibly lock on the floating heelblock by interdentate rotation of mating teeth as the arms are operatively rotated from upright to horizontal.

Upon flexing of the ski, the sliding travel of the heelblock allows forward and backward travel of the transverse pivot axis of the stinger arms with respect to a fixed point of origin or "set point" on the rail system. A spring or spring is used to provide a restoring force to return the heelblock to the set point when the ski is unstressed. Flexing of the skis can occur in extreme air jumps, hard mogul skiing, and ski mountaineering, for example, styles of skiing that are not readily accommodated with conventional AT bindings. In fixed heel mode, optionally the lock may be tightened by an interference fit between the taper of the teeth, and a detent stop may be provided so that the rotatable stinger arms cannot be unintentionally moved during skiing.

In free heel mode, by instead turning the stinger arms downward so that one of the heel risers, or as sometimes termed here "climbing bars", can rest on the saddle on the top of the heelblock, the skier's heel can be interchangeably supported in one or more raised positions, as is advantageous for climbing with skins, crampons, or trekking in free heel mode. Multiple heel elevation angles can be achieved with multiple detent points.

These and other aspects of the invention will now be described in more detail in the following section.

DETAILED DESCRIPTION

Certain meanings are defined here as intended by the inventors, ie. they are intrinsic meanings. Other words and phrases used here take their meaning as consistent with usage as would be apparent to one skilled in the relevant arts. When cited works are incorporated by reference, any meaning or definition of a word in the reference that conflicts with or narrows the meaning as used here shall be considered idiosyncratic to the reference and shall not limit or supersede the meaning of the word as used in the disclosure herein.

Definitions

Several types of ski bindings are available. "Alpine" or "downhill" bindings are designed for attaching both heel and toe to the skis and are considered safest. The boot sole is relatively rigid. Telemark or "Nordic" skiing typically involves a fixed toe and a heel cable harness so that the boot flexes at the ball of the foot and the heel can pivot in the harness.

In contrast, alpine touring (AT) bindings are modified to provide both fixed heel and free heel configurations as used in "alpine touring". Alpine touring involves a combination of downhill alpine skiing, and back-country or cross country trekking or mountaineering, often without the convenience of ski lifts. Alpine touring can also involve jumps and more aggressive skiing on moguls or rough terrain. Alpine bindings are preferred by many skiers because AT bindings are perceived to be loose, sloppy, and unsafe. It is generally believed that AT ski bindings are not as strong as and do not have the performance of alpine ski bindings, but have added convenience and flexibility.

According to one aspect of the present invention, an AT-type ski binding mounting system with floating heel lock is provided for alpine touring with alpine ski bindings. When the AT mounting system of the invention and alpine ski bindings are sold together, the combination is termed an "AT binding/mounting adaptor combination". The adaptor assembly with elongate support member for the ski bindings serves as a hinged extension of the ski and can pivot at the toe. Thus an alpine binding, which is designed for fixed heel downhill skiing, can be adapted for alpine touring by use of an adaptor mounting system of the present invention. This combination is stronger, has a better heel lock, and provides more performance than a conventional AT ski binding.

"Tip" refers to the toe end of the ski; "tail" refers to the heel end of the ski; the ski in general may have a camber or reverse camber, or a combination of both. The center section may also be referred to as the "waist" of the ski, and may have side cut, or reverse side cut, or a combination of both.

"Bowing" of a ski refers to dynamic upward bending of the tip or tail with respect to center section of the ski under load, as in landing a jump. "Cupping" of the ski refers to downward displacement of the tip or tail.

"Floating" indicates that a mechanical element has at least one degree of freedom of sliding movement while serving as a linkage between two other members, so that the two linked members remain joined over a range of travel with respect to each other.

"Performance" of a ski refers to the transmission of power by the skier to the edge of the ski, as in carving.

Engineering and Operative Features

Figure 2:
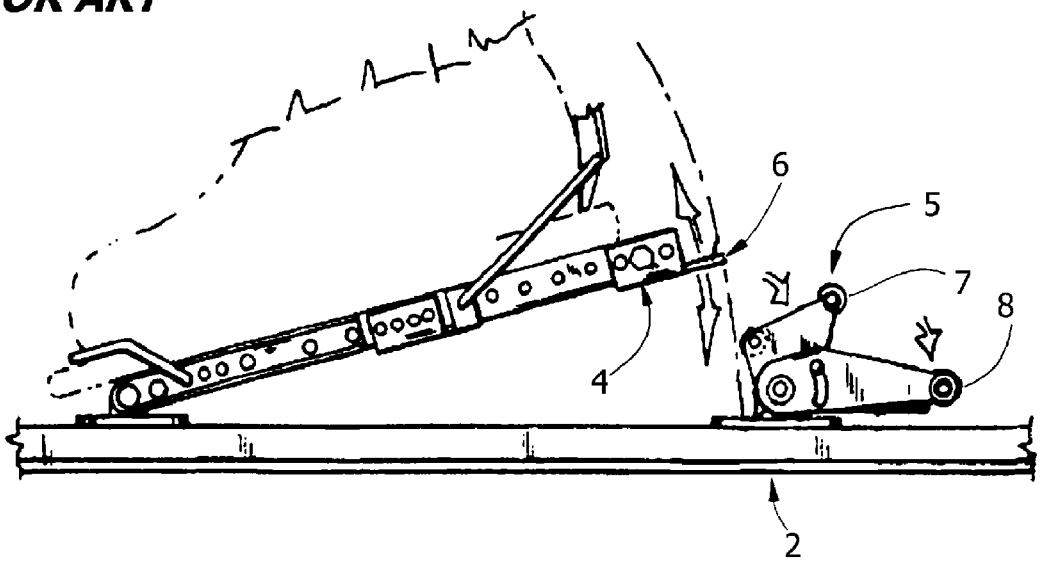
Fig. 2 PRIOR ART

Turning now to the figures, FIGS. 1 and 2 illustrate devices of the prior art. As drawn, both pivotable frames (1,4) include integral binding elements for securing the boot to the ski blade (2). In FIG. 1, The heel fixator post (3) is permanently placed on the ski and cannot travel to accommodate flex of the ski. Similarly, in FIG. 2, the clasp (5) is modified to reversibly engage a tab (6) projecting from the heel frame or plate (4) and rotates up and away to release the heel plate. The clasp is modified to include a pair of risers (7,8) for supporting the heel at one of two angles above the ski. However, these prior art teachings do not accommodate flexing of the ski, which can damage the ski blade (2) or result in inadvertent release of the heel lock.

Figure 3:
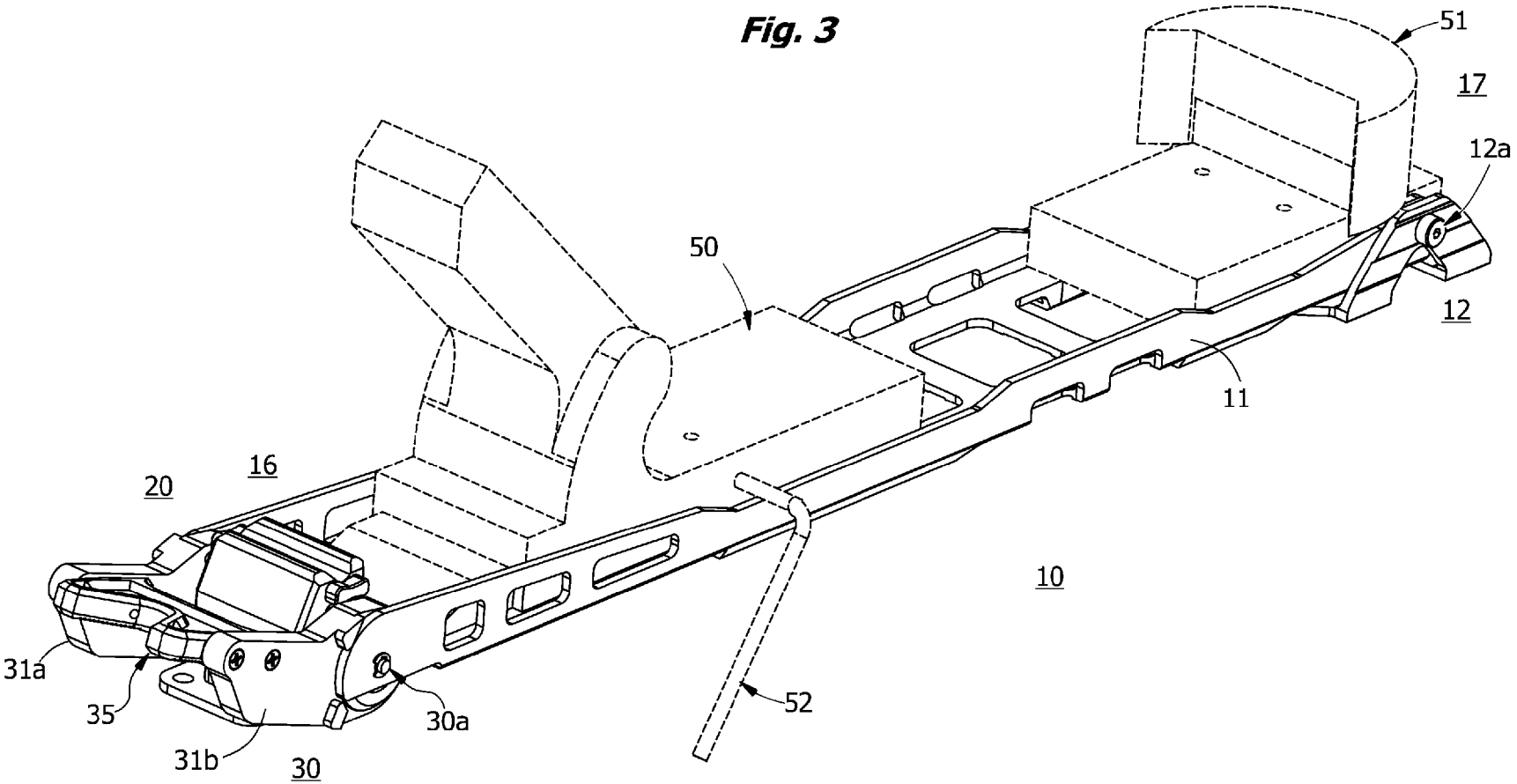
FIG. 3 is a perspective view of a first embodiment of the invention, with adaptor mounting plate hinged at the toe and having a heel locking mechanism with floating heelblock and drop-down climbing bar assembly.

In FIG. 3, a first embodiment of a ski binding adaptor (10) of the present invention is depicted, with dashed lines indicating components optionally supplied by the consumer and normally used in combination. The ski bindings, indicated by dashed lines (and any accompanying boot), may be supplied with the invention or supplied separately. Indicated by dashed lines are a toe piece (51) and a heel piece (50) with jaws for securing the sole of the boot. Conventional heel pieces are typically supplied with a ski brake (52), and include other features as are known in the art. Release mechanisms may also be incorporated. These conventional binding elements may also take the form of bails or cables, if desired, as are compatible with downhill or alpine ski boots. As shown for purposes of illustration, the elongate support member of the invention is depicted as a channel beam (11), but is not limited thereto. The channel beam was chosen because of the low profile that may be achieved by nesting the ski bindings in the open channel, where lateral ribs provide support and lateral stability. The channel beam (11) is hinged at the toe and has a floating heelblock with locking mechanism and integrated drop-down heel riser, the floating heelblock assembly (20) for absorbing cupping and bowing flexion of the ski under the channel bar. The drop down heel riser or climbing bar with rotatable stinger arms (also termed "lever arms") is part of the heel-locking mechanism and serves multiple functions.

Channel beam (11), which supports the ski binding, is attached at a pivot axle (12*a*) to a toe pivot cradle (12) or front mounting bracket. The channel beam is generally an elongate bar, beam, frame, or other extruded, folded, machined, injection molded, or metal or reinforced plastic member having the function of providing a pivotable surface for mounting and supporting the toe and heel pieces of the ski bindings, and thus extends from a toe end (17) with pivot to a heel end (16), and may be extensible if desired. More generally, what is termed here for illustration the "channel beam" (11) is an "elongate ski binding support member" on which the ski binding elements and boots are mounted. The channel beam is mounted with a clearance from the upper face of the ski. The heel and toe pieces may be mounted at variable distances from the toe pivot pin to suit the size of the boot and the geometry of the release mechanisms (not shown). Optionally, the channel beam may be supplied in differing sizes to accommodate various boot sizes and ski widths. The ski binding adaptor assemblies (10) may be sold as pairs which are interchangeable for left and right foot, or may be sold as pairs of right and left fitted adaptors.

Attached at the heel end of the channel beam is a stinger arm assembly (30) which includes a pair of opposing arms (31*a*,31*b*) joined by a "heel riser" or "climbing bar" (35) that function to support the heel in a raised position when the stinger arms are rotated down.

Between the rotatable stinger arms is the floating heelblock (21), with dentate lateral faces which engage inwardly facing mating teeth in the walls of the stinger arms, and with a topmost saddle that supports the heel riser, as will be described in more detail below. As shown, the stinger arm or stinger arm assembly and the heelblock are interlocked so that the channel beam cannot pivot when the heel is locked down. By rotating the stinger arms vertically on the stinger arm pivot, the heel lock mechanism unlocks and the skier may select free heel mode. When unlocked, the stinger arms can be easily disengaged from the heelblock and are free to rotate on the channel beam. With the heel unlocked, the channel beam is free to pivot at the toe, as in ski touring and climbing modes.

Figure 4:
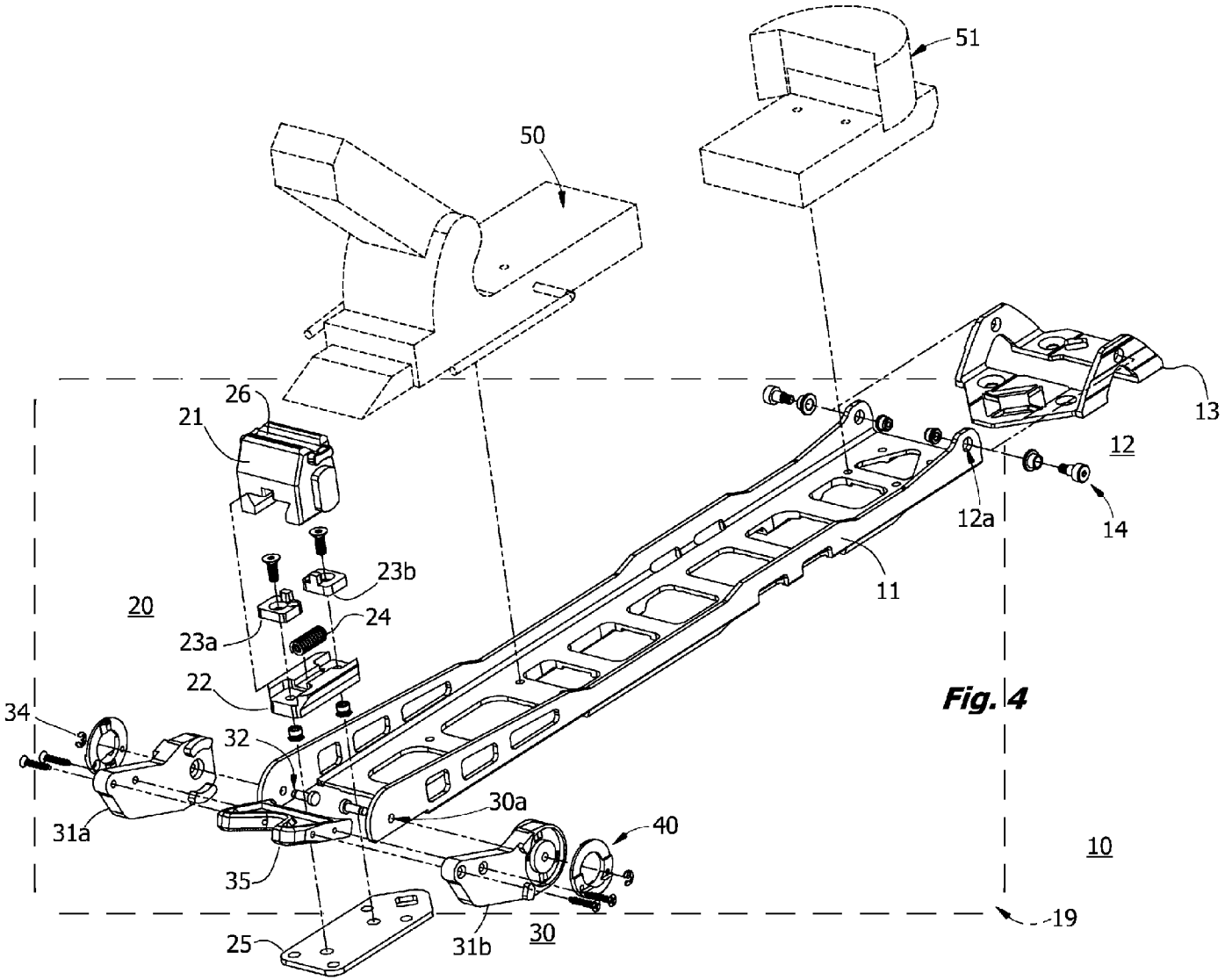
FIG. 4 is an exploded view of a first embodiment of the invention.

FIG. 4 is an exploded view of the embodiment of FIG. 3. Optional components of the ski binding assembly are again drawn with dotted lines. The channel beam (11) is seen here as an elongate channel with folded or extruded side ribs adapted for mounting pivot pins (14) of the toe pivot axis (12*a*) at the front nose and stinger pivot pins (32) of the stinger arm pivot axis (transverse pivot axis, 30*a*) in the rear of the channel. The toe and heel pieces (50,51) can be adjustably attached within the channel much as they are conventionally attached to the surface of the ski. As shown here, the toe pivot assembly (12) is provided by toe pivot cradle (13) with pivot pins (14) engaging channel beam (11) at pivot axis (12*a*). The channel beam is thus adapted for providing a toe pivot function for downhill ski bindings and in a "universal adaptor mounting plate" or "universal AT ski binding adaptor" embodiment, is broadly compatible with multiple makes of conventional ski bindings currently available. Alternatively, the elongate support member may be configured to mate with only a particular ski binding or a select group of ski bindings. It can be seen that the channel beam (11) includes honeycombing or cutouts for reducing weight, but can be variously shaped for flexural strength, for example as a tubular member or with multidimensional ribs or tubular folds for increased rigidity. The width of the "channel" is shown here as configured for attaching a conventional ski binding with heel and toe pieces, but may also be configured to support custom toe and heel pieces that slide up and down on a "tubular beam" with end tees fitted for the heel and toe pivots, or other functionally equivalent structures. Thus "channel beam" includes open channels, closed channels, and a variety of structural beam shapes having one or more cross-sectional profiles. The cross-sectional profiles include but are not limited to: a "U-shape", a box-shape, a tube-shape, a plate-shape, a bar shape, a beam shape, a "Tee" shape, or an "H-shape". Advantageously, the open "U"-channel as shown positions the user's ski bindings in close proximity to the surface of the ski so as to mimic the sensation when riding that the bindings are directly attached to the ski.

In exploded view, the floating heel lock assembly (20) is seen to consist of a rail mounting baseplate (25), which is affixed to the upper face of the ski, a dovetailed rail (22) for engaging the dovetailed channel on the underside of the heelblock (21), a pair of stop blocks (23*a*,23*b*) for controlling the range of travel of the floating heelblock, a spring (24) for opposing and restoring displacement of the heelblock from center on the long axis of the rail (22), and fasteners. Spring (24) is used to bias the floating heelblock in the center of its range of travel. Travel on either side of the center is opposed by the spring, and generally is restricted to about 6 to 10 mm (more if desired) on either side of center, as has been found by experience to be sufficient for most skiers to comfortably accommodate flexion of the ski.

The dovetail rail (22) is generally lubricated so that the heelblock slides easily along the rail, and may be replaced by rails of other geometry. The assembly can be sealed so that snow or ice does not become impacted inside the works, for example an elastomeric boot or bonnet.

In this embodiment, the stinger arm assembly (30), consists of a right and left stinger arms (31*a*,31*b*) with pivot pins (32) and circlips (34, or other fastener) for rotatably securing the arms to the channel beam at transverse pivot axis (30*a*) are also provided with a detent mechanism (40), as will be described in more detail below. Heel riser or "climbing bar" (35) joins the two stinger arms (here shown with fasteners) and optionally the stinger arms and heel riser may be formed as a single piece. The stinger arm is both a locking mechanism and structural support, which can disengage from the heelblock and rotated to an inferior standing position under the heel to elevate the heel end of the channel beam. To rest the heel in elevated position, the stinger arms (31*a*,31*b*) are rotated downward so that the heel riser (35) rests on a saddle (26) formed on the top surface of the heelblock (21), as described further in FIG. 16. The stinger arms may also be rotated to a superior standing position and held in place by a detent means, as is useful in engaging the heel lock, as will be described below.

By detaching the stinger arm assembly and floating heelblock from the rail mounting baseplate ((25) and detaching the toe pivot pin from the toe pivot cradle (13), the channel beam (11) and stinger arm assembly (30) can be lifted up as a single unit and transferred from ski to ski, as is useful when the adaptor mounting plate will be used with multiple skis. Optionally sold separately are toe cradle (13) and rail mounting baseplate (25) with fasteners that can be installed on multiple pairs of skis so that the channel beam/stinger arm/floating heelblock combination (19) may be exchanged between skis as a portable, undivided subassembly, where the stinger arms are locked on the heelblock during transfer. This takes fullest advantage of the alpine-touring cross-sport functionalities of the ski binding adaptor assembly of the invention. Alternately, the heelblock and rail can be redundantly pre-positioned on each ski pair, so that the skier can toollessly transfer the channel beam and stinger arms from ski to ski using a quick release fastener on the toe pivot cradle.

Figures 5A, 5B, 5C, 5D:
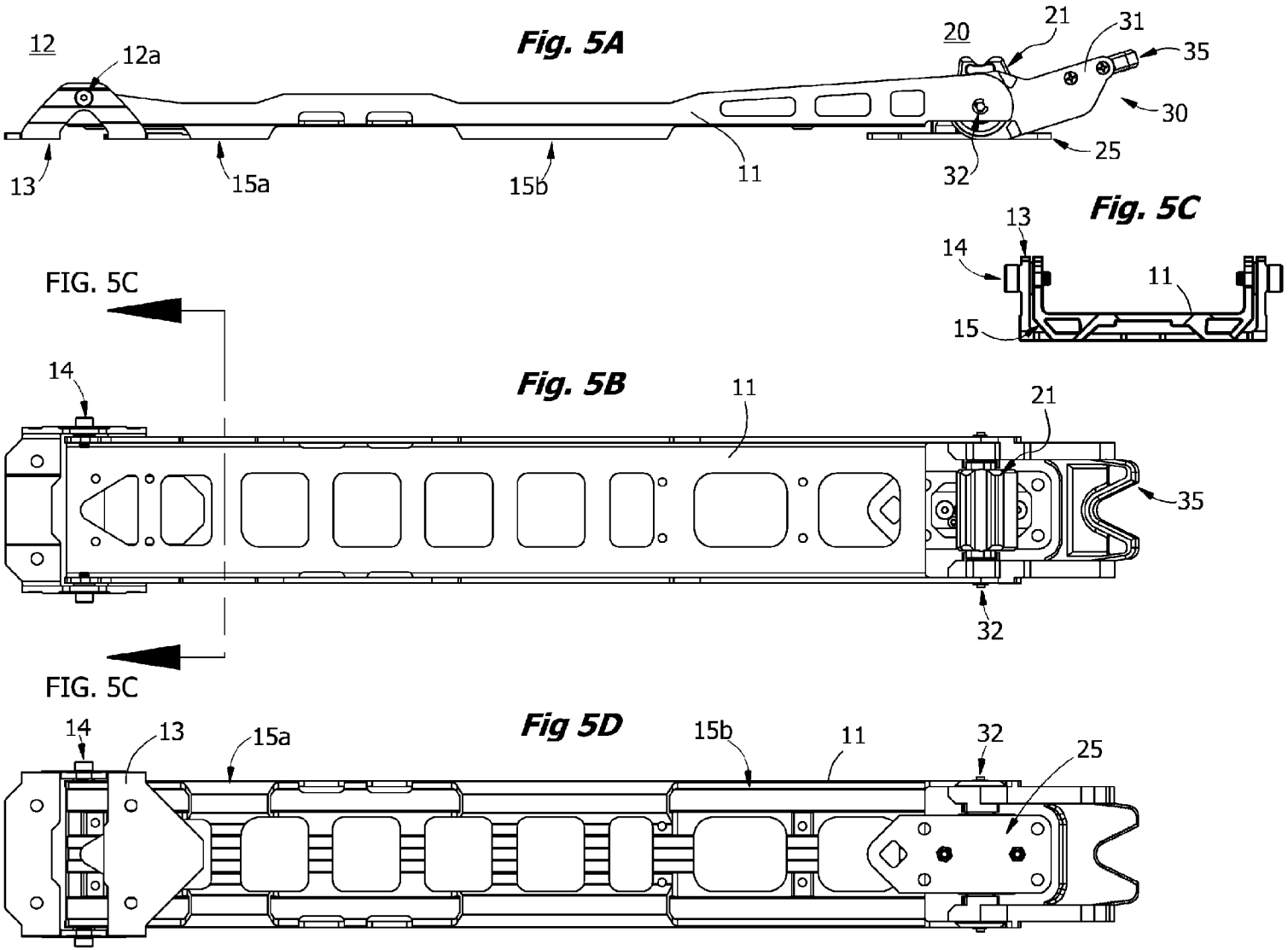
FIG. 5A is an elevation view.
FIGS. 5B and 5D are plan views.
FIG. 5C is a cross-section through the channel bar.

FIG. 5A is an elevation view of the first embodiment the AT ski binding adaptor assembly of the invention as depicted in FIGS. 2 and 3. Channel beam (11), toe pivot assembly (12), toe pivot cradle (13), floating heel lock assembly (20) with heelblock (21) and rail mounting baseplate (25), stinger arm assembly (30) with stinger arms (31) and stinger pivot pin (32), and heel riser (35) are identified in the drawings.

FIGS. 5B and 5D are top and bottom plan views marked as shown. Also indicated is the location of a cross-section through the channel beam. As shown in FIG. 5C, the channel beam (11) may have a complex sectional profile, here with tubular "feet" (15) and with lateral ribs for attaching the channel beam to the toe pivot cradle (13) by pivot pins (14). The position of tubular feet (15*a*,15*b*) is also shown in FIGS. 5A and 5D, and can prevent excessive ski cupping, such as in jumps, if desired.

Figure 6:
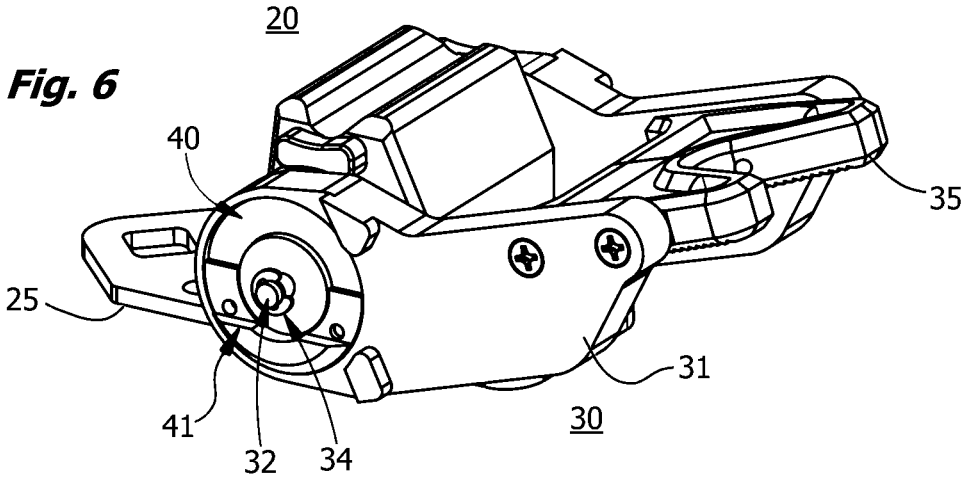
FIG. 6 is a perspective view of the floating heel lock assembly with "stinger" or lever arms and climbing bar.

FIG. 6 is a perspective view of the floating heel lock assembly (20) in combination with the stinger arm assembly (30). Not shown are the heelward extensions of channel member (11), which are secured over the stinger arms (31) on stinger arm pivot pins (32) by circlips (34) and rest on lateral lip surfaces (41) of the stinger arm detent disk (40). The stinger arm pivot pins are disposed on a transverse pivot axis through the heel end of the elongate support member or channel beam (not shown). Also shown is heel riser (35) and rail mounting baseplate (25). Operation of the detent mechanism will be discussed in reference to FIGS. 12-14 below.

Figure 7:
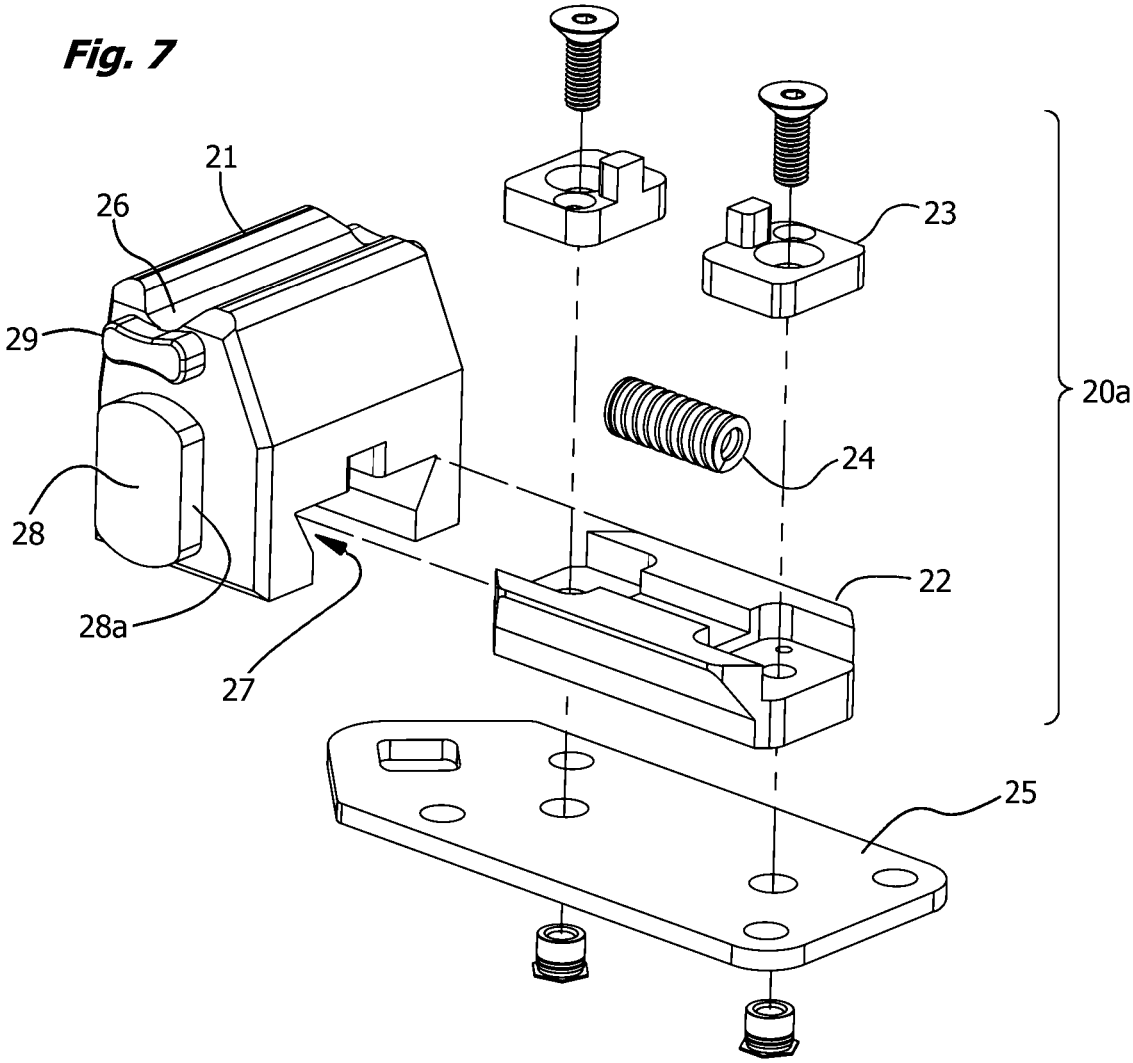
FIG. 7 is an exploded view of the floating heel lock assembly with "dovetailed" rail and spring.

FIG. 7 is an exploded view of the floating heel lock assembly (20). The floating heelblock (21) is secured to the dovetail rail (22) by dovetail channel (27) and by captive spring (24), which mates with an internal cavity in the dovetail channel and is arrested in place by stop blocks (23). Moving the heelblock along the sliding rail in either direction compresses the spring (24) and produces a restoring force that returns the heelblock to its resting center position when released.

The heelblock is also characterized by a saddle groove on top for seating the heel riser in a heel-elevated position characteristic of touring or climbing mode, and by dentate lateral faces for lockingly engaging mating toothed surface of the stinger arms, as will be described below. Key boss (28) is a cylindrical tooth with contralateral guide flats (28*a*) for receiving the stinger arms. Guide tooth (29) is a biconcave tooth for interlocking with arcuate teeth on the inside surface of the stinger arms and for supporting the stinger arms in free heel configuration.

Figure 8A:
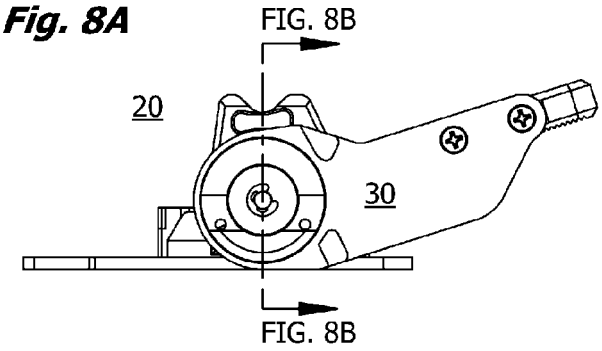
FIGS. 8A through 8H depict elevation and cross-section views through the floating heel lock assembly, components and subassemblies.
Figure 8B:
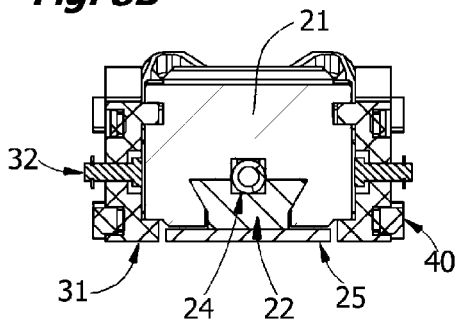

FIGS. 8A through 8H depict elevation and cross-section views through the floating heel lock assembly, components and subassemblies. In FIG. 8A, shown is the location of a cross-section on the stinger arm transverse pivot axis. FIG. 8B depicts the stinger arm pivot pins (32) through stinger arms (31) on each side of central floating heelblock (21). The floating heelblock is sectioned across the dovetail channel and engages dovetail rail (22). The mechanism rests on baseplate (25). Center position of captive spring (24) is also shown.

Figure 8C:
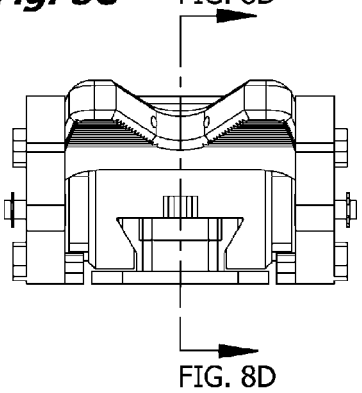
Figure 8D:
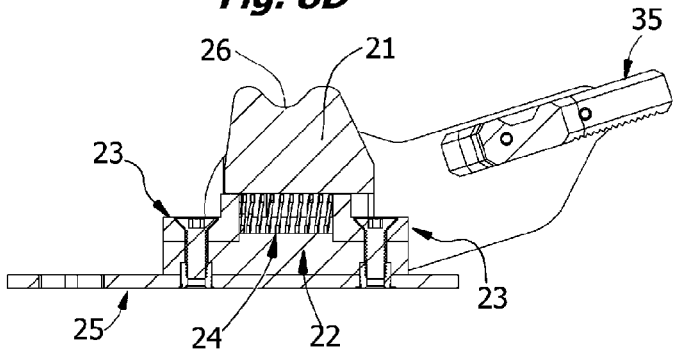

FIG. 8C indicates the position of a cross-section orthogonal to the preceding figure, where in FIG. 8D is shown the floating heelblock (21) with cross section through saddle (26) and the captive spring recess with captive spring (24). The dovetail rail (22) is cut on the long axis and fasteners for the stop blocks (23) are seen. The heel block is at a natural position of rest in the center of the dovetail rail; its range of longitudinal travel is bounded only by step plates (23) on each side.

Figure 8E:
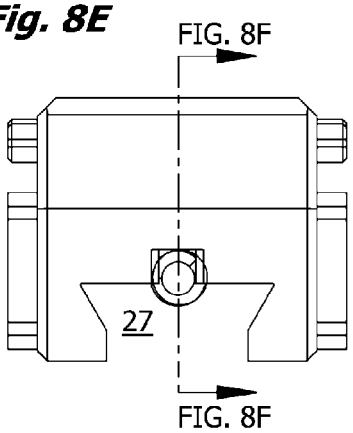
Figure 8F:
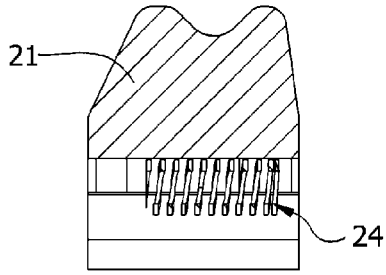
Figure 8G:
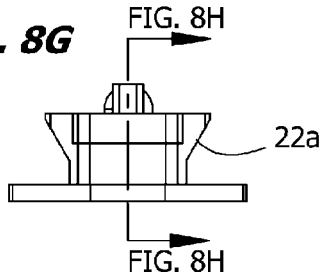
Figure 8H:
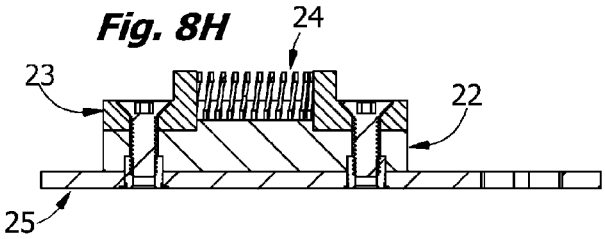

FIG. 8E marks the cross-sectional plane seen in FIG. 8F, showing only the heelblock (21) and the captive spring (24) as well as the dimensions and shape of the dovetail channel 27. FIG. 8G marks the cross-section depicted in FIG. 8H, where the dovetail rail (22) is sectioned lengthwise. Shown are stop blocks (23) butted against captive spring (24) and baseplate (25). The lateral sloped flanges (22*a*) of the dovetail rail (22) are configured to engage the dovetail channel (27) shown in FIG. 8E and the flanges and upper surfaces of the rail are generally greased to promote a smooth sliding action of the floating heelblock (21) longitudinally along the rail.

Figure 9:
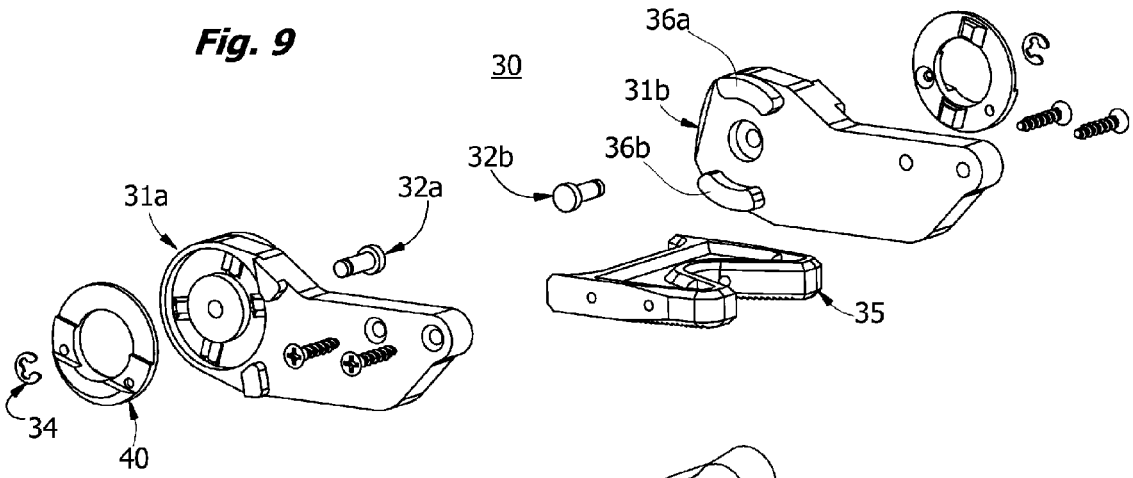
FIG. 9 depicts an exploded view of the stinger arms and heel riser or "climbing bar" assembly.

In FIG. 9, an exploded view of the stinger arm and heel riser assembly (30) is depicted. Stinger arms (31*a*,31*b*) are pinned to the heelward extension of the channel beam or bar member (11) by pins (32*a*,32*b*). Equivalent fasteners may also be used. The two arms are joined posteriorly by heel riser (35). Mounted between the stinger arms and the posterior tabs of the channel beam (not shown) are detent disks (40). Circlips (34) or other fasteners are used to secure the assembly on its pivot axis between the two ribs of the channel beam. The stinger arms are configured for rotating from a standing position of about "vertical-up" to about "vertical-down", i.e., about 180 degrees in this case. Arcuate teeth (36*a*,36*b*) engage the key boss of the floating heelblock, as will be described next.

Figure 10:
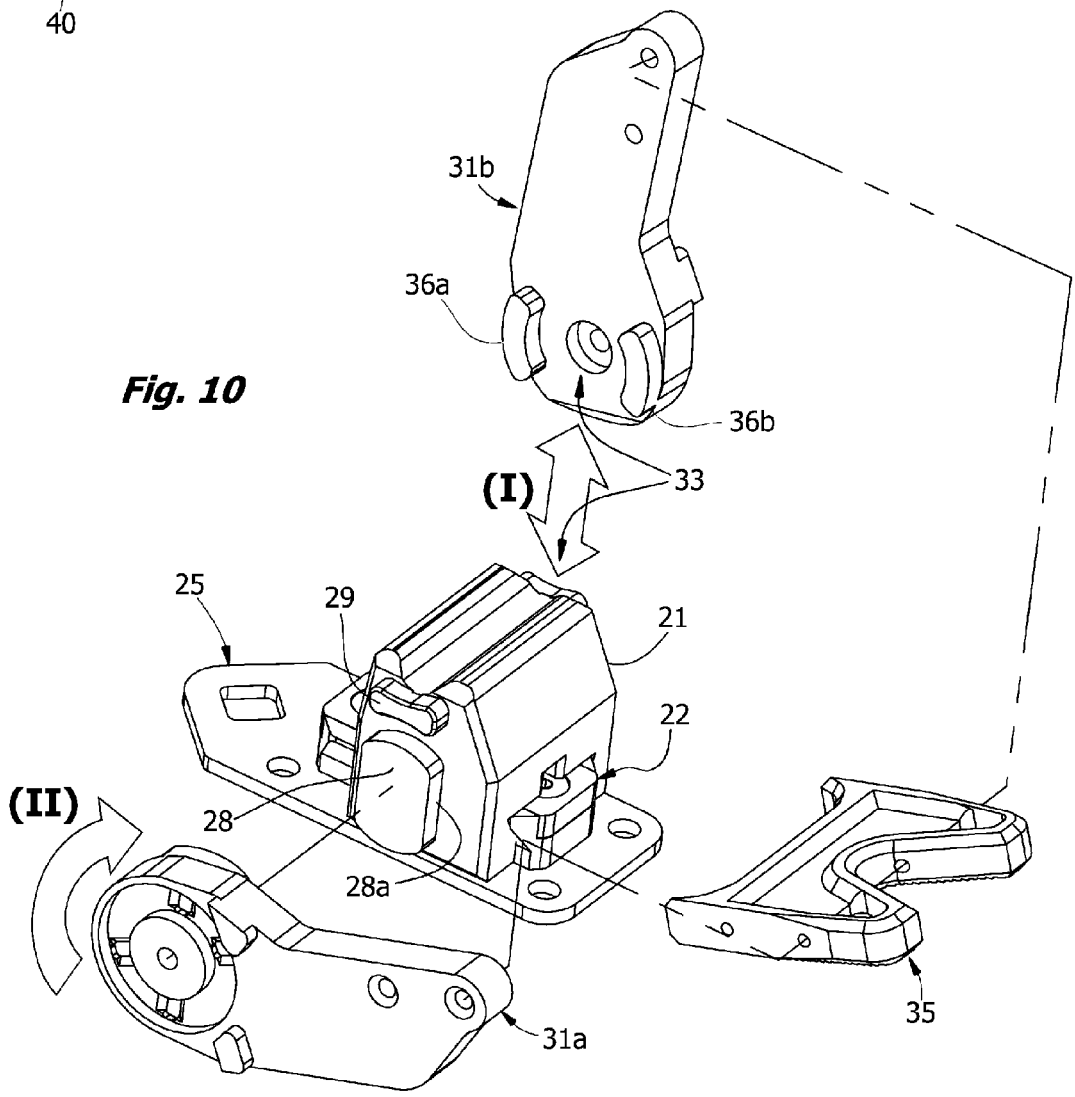
FIG. 10 illustrates the rotating action of the stinger arms. The two arms are bridged by the climbing bar and move as a single unit, but are shown here in alternate positions for engaging and locking on lateral bosses of the floating heelblock.

Turning now to FIG. 10, the rotating action and lock engagement functions of the stinger arms are illustrated. For compactness of representation, the arms are shown independently in alternate positions, although in practice the arms are joined together in mirror symmetry by heel riser (35). The two arms move as a single unit, but are shown here in alternate positions to illustrate the concept of a "keyway" (33) formed as a slot between the arcuate teeth of the inside surface of the stinger arms, the keyway slot having dimensions and alignment for receiving the key boss (28) and guide tooth (29) of the floating heelblock. The stinger arm assembly is properly aligned and then dropped down onto the key boss. In a first step, action arrow (I) indicates that the stinger arm (31*b*) is positioned vertically so that the keyway is open for receiving the guide flats (28*a*) and key boss of the floating heelblock. In a second step, action arrow (II) indicates that the stinger arms are rotated clockwise so that arcuate tooth (36*a*) slips between guide tooth (29) and key boss (28) while arcuate tooth (36*b*) slips under the key boss. The interdentate engagement of the teeth forms a non-slip lock between the stinger arms and the floating heelblock, locking the heel end of the channel beam to rail mounting baseplate (25) while permitting sliding motion of the heelblock (21) on the dovetail guide rail (22). The locked position is indicated by the position of arm (31*a*).

To unlock the heel, the steps are simply reversed, as shown in FIGS. 11A-C. From the locked position (FIG. 11A), rotation of the stinger arm to the upright position opens the keyway and permits the stinger arm with arcuate teeth to slide free of the key boss on the heelblock as shown. In step (III), the stinger arm is rotated to the upright position, with guide flats (28*a*) and guide tooth (29) aligned with the keyway (33), and in step (IV) the stinger assembly, with channel beam, is lifted away from the heelblock (FIG. 11C).

FIGS. 12A and B show a back face of a detent disk (40) with detent posts (42) and the mating surface of a stinger arm (31) with female detent stops (43). Dotted line (11*a*) indicates the position of the lower edge of the channel beam (11). Detent disk (40) is fitted against the stinger arm and is aligned on the center axis of the stinger transverse pivot axis (30*a*) in the groove indicated. The detent disk is held against the lower edge of the channel beam and does not rotate, but as the stinger arm rotates, three detent positions are realized, up, down and at an angle where the stinger arms project posteriorly and are generally parallel to the channel beam. Additional detent stops may be positioned as desired.

FIG. 13A and FIG. 14 are CAD views of the detent disk (40) to more fully illustrate the shape of the male detent posts (42) and the docking lip (41) that lines up on the lower edge (11*a*, dotted line) of the channel beam during assembly.

FIG. 13B is a view edgewise of the detent disk, which is thin and can be formed out of an elastomeric material such as nylon so that deformation during transition from one detent stop to another is accommodated by the material.

FIGS. 15A-D are a series of four views showing alternate alpine and touring configurations of an AT ski binding adaptor assembly of the invention with ski bindings (dotted lines). In each view, the toe end of the supporting channel beam is secured in a toe pivot cradle assembly (12), but the heel end (16) of the channel beam can be in one of four positions. In the four views, the stinger arms are shown to have about 180 degrees of rotation and are supplied with detents at three positions corresponding to the configurations shown. In a preferred embodiment, to raise the heel risers or to lock down the heel, the stinger arms may be manipulated using the tip or skirt of a ski pole or by hand. The heel riser is webbed and the surface is textured so that a ski pole engages it without slipping.

Figure 15A:
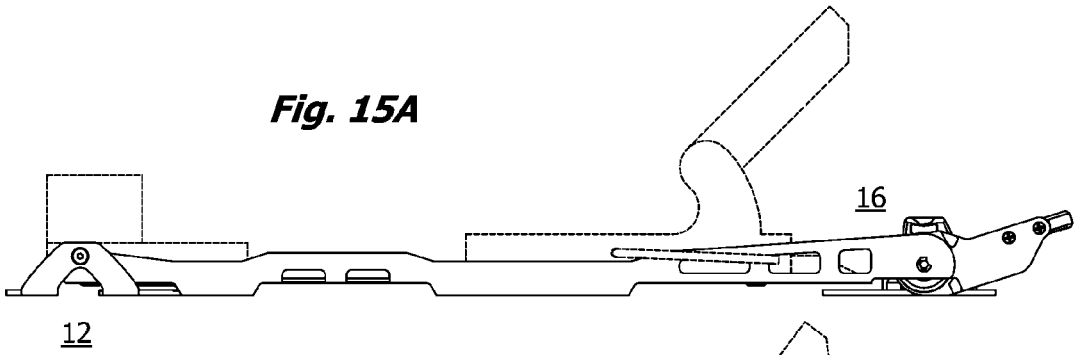
FIGS. 15A-D illustrates AT ski positions supported by configuring the stinger arm assembly.
Figure 15B:
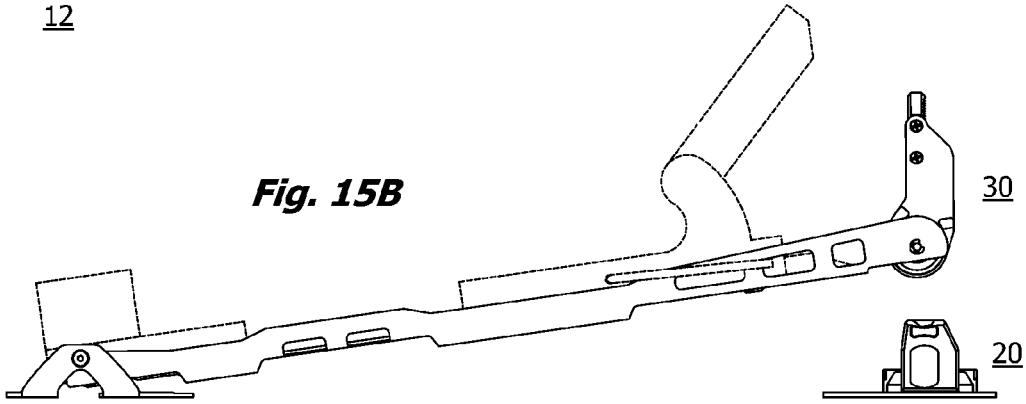

In a first position (FIG. 15A), the stinger arms engage the key bosses of the heelblock and lock down the heel end against the ski in "fixed heel mode" as shown. In a second position corresponding to "free heel mode", the heel end of the adaptor is free to pivot as shown in FIG. 15B and the stinger arms are in the vertical position. In the vertical position, the arms are held in place by detent stops and the keyway is aligned to slip up or down onto the key boss of the heelblock so that the heel can be locked down or unlocked as required. Once fitted over the key boss, a simple clockwise rotation to the position of FIG. 15A locks the skier's heels against the ski. The details of the rotational operation and use of the keyway is shown in more detail in FIGS. 10 and 11A-C. However, the position shown in FIG. 15B may also be used for free heel skiing: the heel can be raised or lowered at will by the skier; the stinger arms having been securely locked in place by the detent disk as described in connection with FIGS. 12 through 14, while the heel is free to pivot.

Figure 15C:
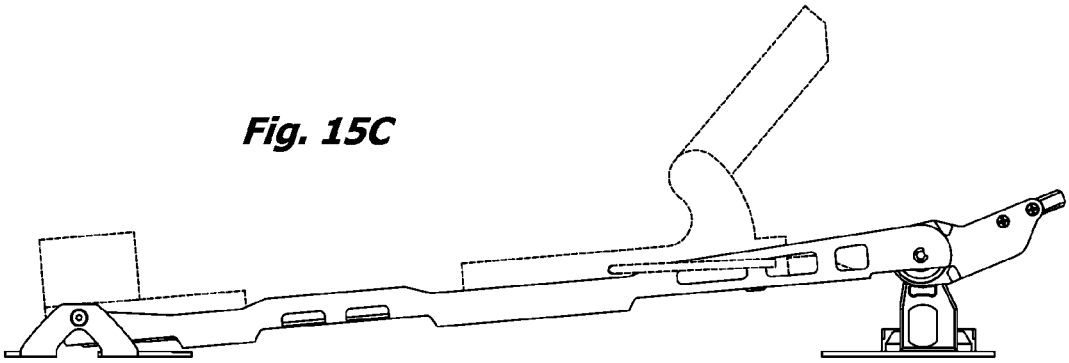
Figure 15D:
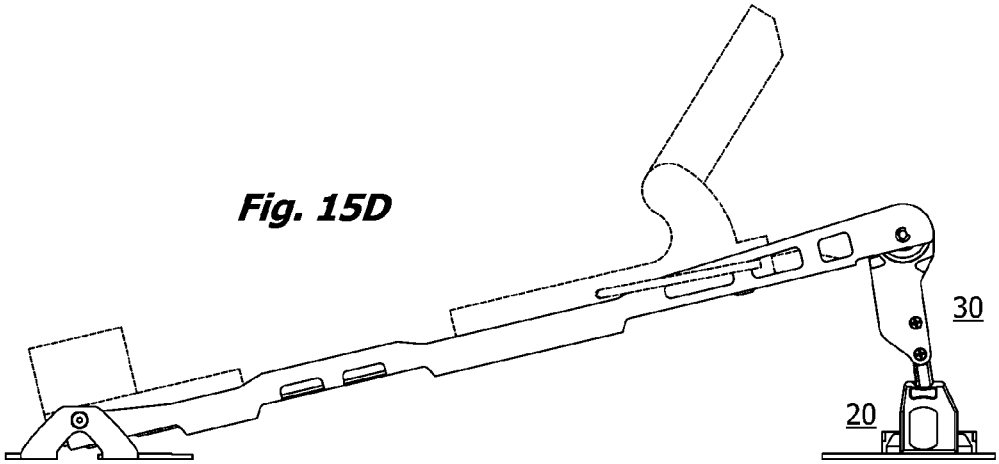

The tips of the heel risers are pointed down in FIG. 15D. In the downward position (inferior standing position), the stinger arms are again held in place by the detent stops and the heel riser is aligned to stand in a saddle on the top of the heelblock. FIG. 15C demonstrates the use of the stinger assembly in an intermediate position, where the arcuate teeth of the stinger arms rest on an upper facet of the floating heelblock and the heel is not locked. A detent is provided for this position, which corresponds to the configuration shown in FIG. 15A except that the teeth of the stinger arms are not locked around the key boss of the heel block but instead rest on top of it.

The configuration shown in FIG. 15D, where the heel riser is standing on top of the heelblock, is useful for uphill trekking where ski lifts are not provide. The ski blades may be used with crampons or climbing skins to ascend a slope without dismounting the skis.

Figure 16:
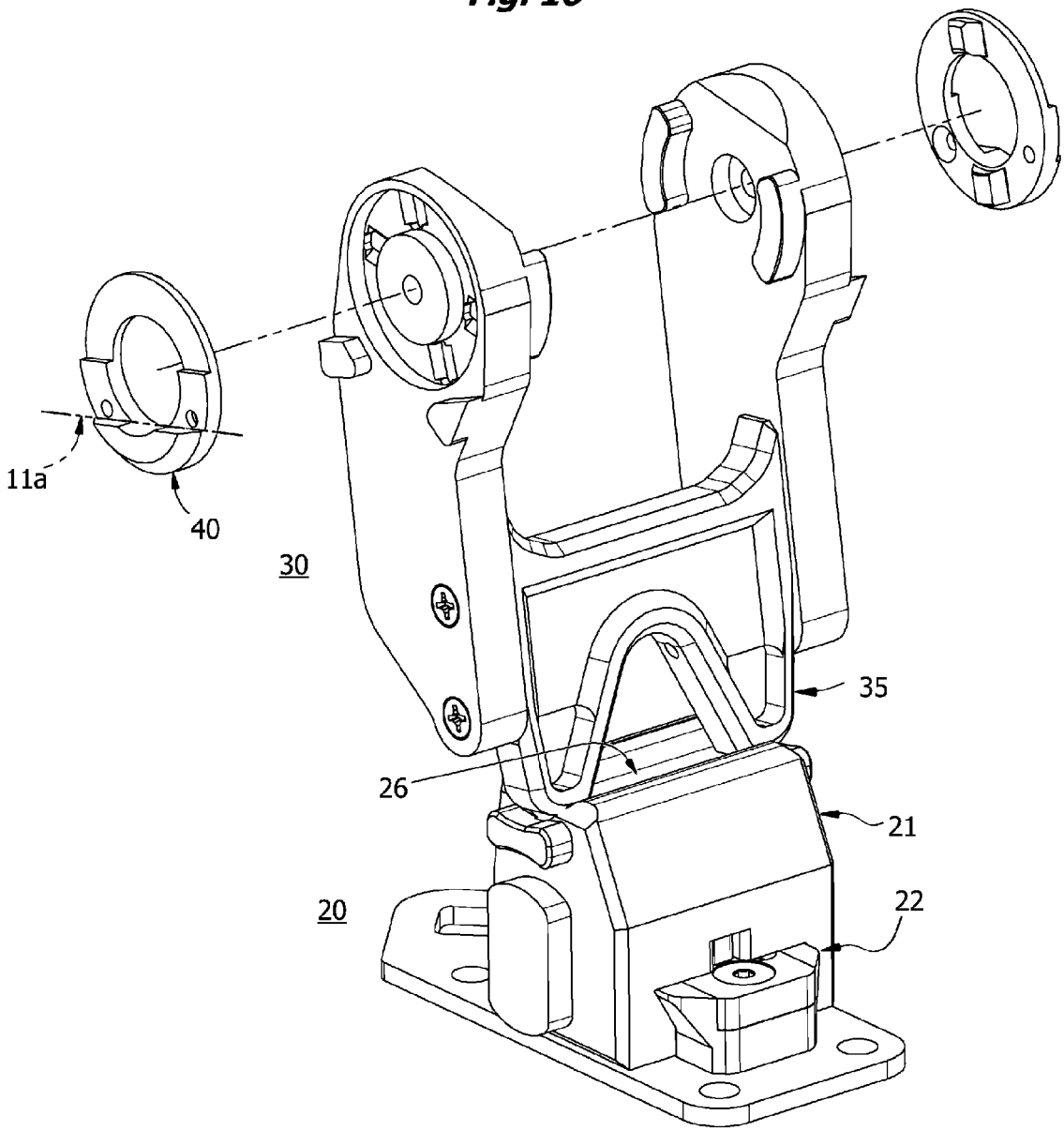
FIG. 16 depicts the stinger arms in a standing position supported on the floating heelblock by the striker assembly. The heel end of the channel beam is supportingly elevated in this configuration.

As realized in FIG. 16, the stinger assembly (30) with heel riser (35) will support full heel weight in an elevated position while resting in the saddle (26) of the floating heelblock (21). In this vertical standing configuration (superior standing position), the bottom edge of the channel beam (11*a*, dotted line) angles down to the toe pivot so that the channel beam, ski blade and stinger arm form a triangle. Elevated heel height is of value in touring mode for climbing with skins or crampons. The heel remains free to pivot as needed, but rests on the heelblock for minimal exertion. The floating heelblock can travel on the dovetail rail (22) to remain in alignment with the stinger assembly during ski flexion.

Schematic Views

Figure 17A:
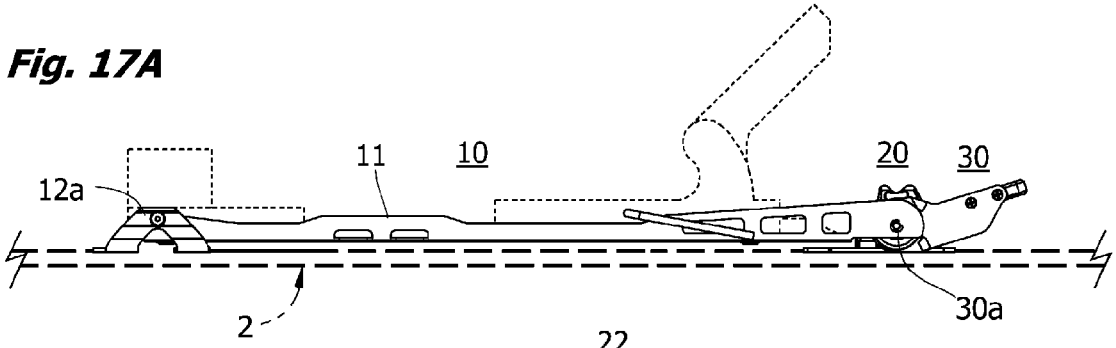
FIG. 17A analyzes the effects of ski flex on the ski binding adaptor with floating heel locking mechanism.
Figure 17B:
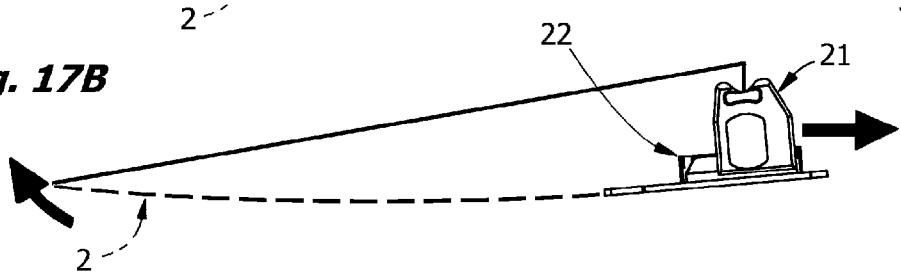
FIGS. 17B and C are schematics, illustrating the way in which ski flex is accommodated by forward and backward sliding of the floating heelblock on a rail or rails.
Figure 17C:
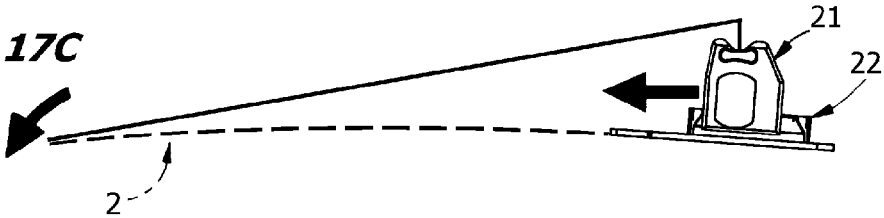

FIG. 17 is a conceptual illustration of the effect of ski flexion on the alignment of the toe and heel fixtures of an inventive AT ski binding adaptor (10) with floating heel lock mechanism (20) and lever arm assembly (30). The elongate support member (11) has a constant length and is fixed to the ski at the toe pivot (12*a*). The heel lock mechanism is locked around transverse pivot axis (30*a*). The geometry can be represented as a right angled triangle, with the elongate support member (11) forming the hypotenuse, the heel lock assembly the height, and the ski blade the base of the triangle. However, the ski blade can bend, so the base of the triangle is not a constant. The rigidity of the triangle must be relieved to accommodate this shift; and the floating heelblock serves this purpose. When the ski blade (2) bows downward (FIG. 17B) or the tip of the ski is forced upward (bent arrow), the heelblock (21) appears to slide posteriorly on the rail (22) (straight arrow indicating motion) while the rail shifts toward the toe of the ski. Similarly, as shown in FIG. 17C, when the ski blade cups upward, or as the tip of the ski is forced downward (bent arrow), the heelblock (21) appears to slide forward on the rail (22) (straight arrow indicating motion) while the rail is forced away from the toe of the ski by the constant beam length of the hypotenuse.

Upon flexing of the ski, the sliding travel of the heelblock allows forward and backward travel of the transverse pivot axis of the stinger arms with respect to a fixed reference point or "set point" on the rail system (where the set point can be viewed as the "normal" position of the heelblock on the rail when the spring element (24, not shown) or elements are unstressed and the ski is in its flat or relaxed position, see FIG. 17A for illustration). Extreme flexing of the ski blade can occur in air jumps, hard mogul skiing, and ski mountaineering, for example, styles of skiing that are not readily accommodated with conventional AT bindings. By permitting sliding travel of the heelblock, the locking mechanism that holds the heel in place is not stressed to breaking. Similarly, stresses around the toe pivot mount and heel mounting bracket or plate are also relieved.

In a preferred embodiment, the floating heel locking assembly (20) is mated to a rotatable lever arm assembly (30) so that the functionality of locking the heel is realized by a rotating motion of the lever arm, which also functions to provide multiple levels of elevation of the heel of the ski binding adaptor in free heel mode.

Conceptually therefore, the invention in a first aspect is an AT ski binding adaptor with floating heel lock assembly for use with skis and ski bindings for alpine ski touring and downhill skiing, which comprises a) an elongate ski binding support member or channel beam having a toe end and a heel end, the elongate ski binding support member for supporting a ski binding, the toe end with a toe pivot assembly with toe pivot cradle adapted for mounting on a ski blade; b) a rotatable lever arm pivotably mounted onto the heel end of the elongate supporting member on a transverse pivot axis therethrough, the rotatable lever arm having freedom to rotate from a superior standing position to an inferior standing position relative to the support member; and c) a floating heelblock slideably mounted on a rail system affixed to the ski blade, the rail system mounted on a rail mounting baseplate attached to the ski blade at a fixed distance from the toe pivot cradle, the floating heelblock with locking member for reversibly engaging the rotatable lever arm in a heel-locked position centered on the transverse pivot axis, the floating heelblock having a range of longitudinal travel on the rail system, the range of travel for accommodating a longitudinal displacement of the transverse pivot axis relative to a set point on the rail or rails as the ski blade flexes or bows.

In another aspect, the AT ski binding adaptor the invention is characterized in that the rotatable lever arm is configured with a keyway for receiving and rotatingly engaging the locking member of the floating heelblock in a fixed heel mode and for counter-rotatingly releasing the locking member in a free-heel mode.

In yet another aspect, the locking member comprises a key boss disposed on an outside lateral face of the floating heelblock, the key boss having a generally cylindrical shape with center axis parallel to the transverse pivot axis of the rotatable lever arm, the generally cylindrical shape having guide flats contralaterally formed thereon, the guide flats for aligning the key boss with the keyway when inserting the key boss into the keyway. The keyway is formed as a slot between a pair of arcuate teeth on an inside lateral face of the rotatable lever arm, the slot having dimensions for receiving the guide flats of the key boss therein, and wherein the arcuate teeth and key boss are dimensioned to operatively interlock when the key boss is inserted into the keyway with center axis of the key boss in coaxial alignment with the transverse pivot axis of the rotatable lever arm and the rotatable lever arm is rotated about 90 degrees to the heel-locked position. The lever arm may be counter-rotated about 90 degrees to unlock and disengage the arcuate teeth from the key boss, whereupon the key boss may be withdrawn from the keyway.

In another aspect, the inventive ski binding adaptors may comprise a captive spring member for operatively opposing the range of longitudinal travel of the floating heelblock on the rail system, wherein the opposing force of the spring member increases with the displacement from the set point.

The inventive ski binding adaptors may also comprise a detent assembly, wherein the rotatable lever arm on the heel end of the elongate ski binding support member has a first detent stop position at the superior standing position for aiding in aligning the keyway with the guide flats, a second detent stop position substantially at zero degrees from the long axis of the support member for arresting the rotatable lever arm in a position generally parallel to the support member, and a third detent stop position at the inferior standing position for supporting the heel end in an elevated free heel position on the ski blade.

These and other aspects of the invention have been illustrated in the afore referenced figures and accompanying description.

Alternate Embodiment

Figure 18A:
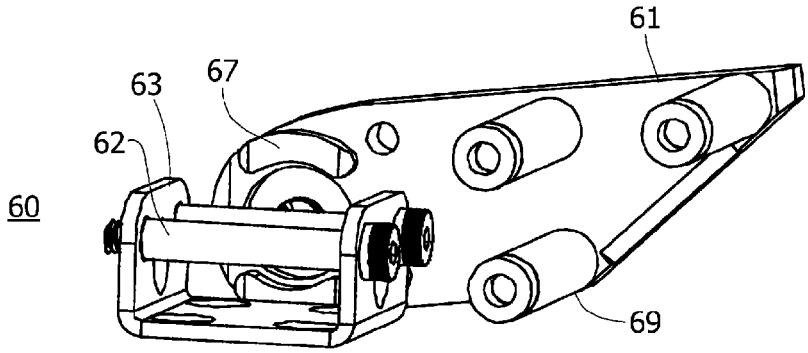
FIGS. 18A, B and 18C relates to a second embodiment of the invention, illustrating a pair of shoulder bolts with smooth shanks for mounting a floating heel block.
Figure 18B:
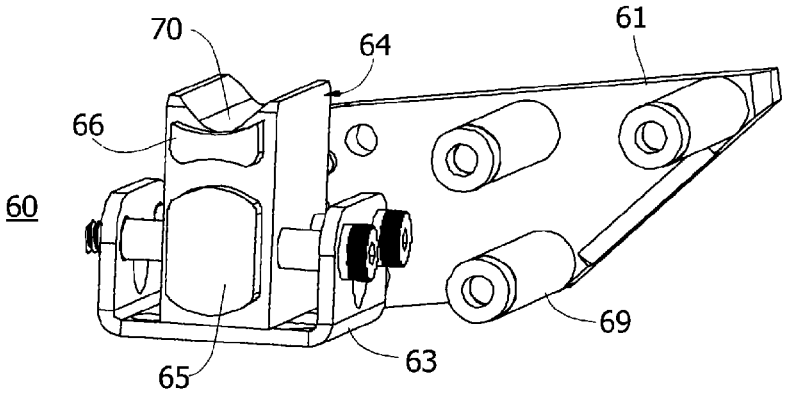
FIG. 18C shows reciprocating springs mounted on the shoulder bolts on which the floating heel block slides.

FIGS. 18A and B are detailed views of a floating heel lock assembly of a first alternate embodiment (60) of the floating heelblock and stinger locking arms, again illustrating the principles articulated with reference to FIGS. 17B-C. In the first view, a partially assembled floating heel locking mechanism with stinger arm (61) is shown. The anterior stinger arm has been removed, revealing a pair of shoulder bolts (62) mounted in a "U-shaped" heel mounting bracket (63). In FIG. 18B, a floating heelblock (64) is shown mounted on the smooth shanks of the shoulder bolts. A clearance is provided between the base of the heelblock and the heel mounting bracket (63) that supports the shoulder bolts. The lateral face of the heelblock is configured with a key boss (65) having vertical flats and a receiving or "guide" tooth (66) above the key boss. These teeth interdigitate with a mated pair of arcuate teeth (67), visible in FIG. 18A, on the inside wall of each of the stinger arms. When the stinger arm assembly is positioned vertically, the teeth of the stinger arms slip down on a keyway around the key boss, and when the stinger arm is rotated clockwise (as shown here), the arcuate teeth engage the opposing keyway surfaces of the heelblock so that the heel of the ski binding adaptor is fixed on the ski in a locked position. This can be reversed by rotating the stinger arms counterclockwise to an unlocked position for free heel mode.

As shown in FIG. 18C, matching coil springs (68), one on each side of the heelblock, position the heelblock in the center of its travel on the shank of the shoulder bolt. Once locked in the teeth of the stinger arms, the heelblock continues to float on its rails, and any displacement of the channel beam forward or backward relative to the heel mounting plate does not result in disengagement of the teeth of the locking mechanism or dampening of ski flex through the entire range of allowed travel. The heel is effectively locked in place. As the ski flexes under the skier, the floating heelblock is free to slide forward or backward on the smooth shanks of the shoulder bolts so that ski flexion is not dampened.

Also visible in FIGS. 18A and B are crossbars that function as multiple heel risers (69) on the stinger arms, here shown in half view. The crossbars are configured to engage the saddle (70) on top of the heelblock when the stinger arms are in downward orientation, thus providing multiple fixed steps for elevation of the heel.

FIGS. 19A-C demonstrates the reversible locking mechanism. By aligning the stinger arm (61) vertically above the key boss, the arcuate teeth of the stingers are configured to slip down over the key boss and guide tooth, and can then be rotated clockwise (FIGS. B and C) to lock on the heel block, analogously to the unlocking steps shown in FIG. 11. Other aspects of the invention in this embodiment are explained in more detail in U.S. Provisional Appl. Ser. No. 61/228,516, which is incorporated herein in full by reference.

Example 1

An adaptor mounting plate of FIGS. 3, 4 and 17 was constructed and tested. For purposes of testing, alpine ski bindings were installed on the mounting plate, which was then attached to a pair of skis. On the bench and in snow, the ski bindings were found to perform as expected, and by use of the floating heel lock mechanism of FIGS. 6-17, the adaptor mounting plate with attached ski bindings was interconvertible for crossover skiing in both free heel and fixed heel modes by rotating the stinger arms from unlocked to locked position. Heelblock travel on the shoulder bolts was found to accommodate flexing of the ski so that no "dead spot" of stiffness on the ski was perceptible.

The mounting hole pattern of the adaptor mounting plate was fitted for a chosen ski binding. Sets of holes were made to accommodate the heel piece of the binding for different sizes of ski boots (e.g. S-XL). Three sizes of the mounting plate, in combination with the adjustability of the ski binding itself, were found to be sufficient to fill in the gaps between the mounting plate sizes. Thus this adaptor mounting plate is specific for a particular ski binding. Interchangeable plate inserts with hole patterns for selected ski bindings are also conceived. In yet another embodiment, the end user is provided with a blank channel which may be customized to mount a ski binding chosen by the user.

Example 2

A "universal" adaptor mounting plate is constructed and tested. This is accomplished by modifying the ski binding mounting hole spacing and pattern so as to accommodate multiple makes of ski bindings. Alternatively, a blank mounting plate is provided, which can be drilled out with custom mounting holes (following a template) specific for any manufacturer's boot bindings, or with a combination of holes for more than one manufacturer's boot bindings. Thus the mounting plate as supplied is not dedicated to a particular binding.

The universal mounting plate is provided with the heel lock mechanism of FIGS. 6-17. The adaptor mounting plate with attached ski bindings is thus interconvertible for crossover skiing in both free heel and fixed heel modes by rotating the stinger arms from unlocked to locked position and the heelblock travels with ski flex while remaining firmly locked in fixed heel mode.

The universal adaptor mounting plate may be configured to be compatible with ski bindings available from any manufacturer, or from a selected group of manufacturers. Thus the mounting plate is not dedicated to a particular binding. Optionally, the adaptor mounting plate can be moved from ski to ski. Optionally, ski bindings may be interchanged on the adaptor mounting plate, as desired by the skier, providing optimal flexibility in a single package.

The appended claims are not to be interpreted as including means-plus-function limitations unless such a limitation is explicitly recited in a given claim using the phrase "means for."

Reference throughout this specification to "one embodiment" or "an embodiment" means that a particular feature, structure or characteristic described in connection with said embodiment is included in at least one embodiment of the present invention, but not necessarily all embodiments. Furthermore, the particular features, structures, or characteristics of any one embodiment may be combined in any suitable manner in other embodiments.

Although the invention has been described in some detail by way of illustration and example for purposes of clarity of understanding, it will be apparent that a range of changes and modifications and combinations with other arts may be practiced while remaining within the scope of the appended claims. For example, while figures relate to a "channel beam" for pivotably supporting the ski binding elements, it will be recognized that equivalent "elongate ski binding support members" having other shapes may be substituted while retaining the full functionality of the invention. Therefore, the scope of the present invention should be determined not with reference to the above description but should, instead, be determined with reference to the appended claims, along with their full scope of equivalents.

All publications and patent applications are herein incorporated by reference to the same extent as if each individual publication or patent application was specifically and individually recited in full herein and are generally indicative of the level of those skilled in the art to which this invention pertains.

We claim:

1. A ski binding adaptor with floating heel lock assembly for use with skis and ski bindings for alpine touring and downhill, which comprises:

a. an elongate ski binding support member having a toe end and a heel end, said elongate ski binding support member for supporting a ski binding, said toe end with a toe pivot assembly with toe pivot cradle adapted for mounting on a ski blade;

b. a rotatable lever arm pivotably mounted onto said heel end on a transverse pivot axis through said support member, said rotatable lever arm having degrees of rotation from a superior standing position to an inferior standing position relative to said support member; and c. a floating heelblock slideably mounted on a rail system affixed to said ski blade, said rail system mounted on a rail mounting baseplate attached to said ski blade at a fixed distance from said toe pivot cradle, said floating heelblock having a locking member for reversibly engaging said rotatable lever arm in a heel-locked position centered on said transverse pivot axis, said floating heelblock having a range of longitudinal travel on said rail system, said range of travel for accommodating a longitudinal displacement of said transverse pivot axis relative to a set point on said rail system as said ski blade flexes or bows.

2. The ski binding adaptor of claim 1, characterized in that said rotatable lever arm is configured with a keyway for receiving and rotatingly engaging said locking member of said floating heelblock in a fixed heel mode and for counter-rotatingly releasing said locking member in a free-heel mode.

3. The ski binding adaptor of claim 2, wherein said locking member comprises a key boss disposed on an outside lateral face of said floating heelblock, said key boss having a generally cylindrical shape with center axis parallel to said transverse pivot axis of said rotatable lever arm, said generally cylindrical shape having guide flats contralaterally formed thereon, said guide flats for aligning said key boss with said keyway when inserting said key boss into said keyway.

4. The ski binding adaptor of claim 3, wherein said keyway is formed as a slot between a pair of arcuate teeth on an inside lateral face of said rotatable lever arm, said slot having dimensions for receiving said guide flats of said key boss therein, and wherein said arcuate teeth and key boss are dimensioned to operatively interlock when the key boss is inserted into the keyway with center axis of said key boss in coaxial alignment with the transverse pivot axis of said rotatable lever arm and said rotatable lever arm is rotated about 90 degrees to said heel-locked position.

5. The ski binding adaptor of claim 4, wherein said rotatable lever arm in said heel-locked position is counter-rotated about 90 degrees to unlock and disengage said arcuate teeth from said key boss, whereupon the key boss may be withdrawn from the keyway.

6. The ski binding adaptor of claim 1, further comprising a captive spring member for operatively opposing said range of longitudinal travel of said floating heelblock on said rail system, wherein the opposing force of the spring member increases with the displacement from said set point.

7. The ski binding adaptor of claim 1, further comprising a detent assembly, wherein said rotatable lever arm on said heel end of said elongate ski binding support member has a first detent stop position at said superior standing position for aiding in aligning said keyway with said guide flats, a second detent stop position substantially at zero degrees from the long axis of said support member for arresting said rotatable lever arm in a position generally parallel to said support member, and a third detent stop position at said inferior standing position for supporting said heel end in an elevated free heel position on said ski blade.

8. The ski binding adaptor of claim 7, wherein said heelblock is provided with a saddle on a superior aspect and said rotating rotatable lever arm is provided with a heel riser member on a posterior aspect, said saddle and heel riser member for supportingly elevating said heel end at one or more elevated positions while ski touring.

9. The ski binding adaptor of claim 1, wherein said elongate ski binding support member with rotatable lever arm, floating heelblock, and rail system is exchangeable as an undivided subassembly between a two or more pairs of skis, each said pair of skis pre-fitted with said toe pivot cradle and said rail mounting baseplate for receiving said undivided subassembly.

10. The ski binding adaptor of claim 1, wherein said elongate ski binding support member is a "U-shaped", a box-shaped, a tube-shaped, a plate-shaped, a bar shaped, a beam shaped, a "Tee" shape, or an "H-shaped" elongate member in cross-section and is configured for mounting with at least one toe pivot pin in a toe pivot cradle affixed to a ski blade.

11. An AT binding/mounting adaptor combination, said combination comprising a ski binding adaptor with floating heel lock of claim 1 and an alpine ski binding.

12. The AT binding/mounting adaptor combination of claim 11, wherein the elongate ski binding support member is configured to be compatible with any ski binding.

13. The AT binding/mounting adaptor combination of claim 11, wherein the elongate ski binding support member is compatible with ski bindings from more than one manufacturer.

14. The AT binding/mounting adaptor combination of claim 11, wherein the elongate ski binding support member is configured for accepting only a particular ski binding or ski bindings from only a particular manufacturer.

15. The AT binding/mounting adaptor combination of claim 11, wherein said combination is bundled with a pair of ski boots.

16. The AT binding/mounting adaptor combination of claim 14, wherein said combination is bundled with a pair of ski boots provided by said particular manufacturer.

17. The ski binding adaptor of claim 1, wherein said elongate ski binding support member is configured to be customized by an end user for use with a ski binding chosen by said end user.

* * * * *